US007726358B2

(12) United States Patent
Hartono et al.

(10) Patent No.: US 7,726,358 B2
(45) **Date of Patent: *Jun. 1, 2010**

(54) METHOD FOR LOADING LNG ON A FLOATING VESSEL

(75) Inventors: John S. Hartono, Oakland, CA (US); Kenneth W. Sheets, Jr., San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 638 days.

This patent is subject to a terminal disclaimer.

(21) Appl. No.: 11/613,582

(22) Filed: Dec. 20, 2006

(65) Prior Publication Data

US 2008/0153369 A1 Jun. 26, 2008

(51) Int. Cl.
*B65B 1/20* (2006.01)

(52) U.S. Cl. ..... 141/82; 141/231; 141/285; 141/387; 62/50.1

(58) Field of Classification Search ..... 141/1, 141/82, 231, 285, 301, 302, 367, 382, 387–389; 441/4, 5; 62/50.1, 50.7
See application file for complete search history.

(56) References Cited

U.S. PATENT DOCUMENTS 3,407,606 A * 10/1968 Khan et al. ..... 405/54
4,315,408 A 2/1982 Karl
4,445,543 A 5/1984 Mead
6,012,292 A 1/2000 Gulati et al.
6,244,053 B1 6/2001 Gulati et al.
2003/0089434 A1* 5/2003 Flynn et al. ..... 149/1
2007/0155260 A1* 7/2007 Poldervaart et al. ..... 441/5
2008/0148741 A1* 6/2008 Hartono et al. ..... 62/50.1

OTHER PUBLICATIONS

Case Study: Stress and thermal analysis of an LNG marine loading arm, http:/www.lusas.com/case/analyst/loadingarm.html, Dec. 13, 2006, pp. 1-3.
Chiksan Marine Loading Arms, http://www.fmctechnologies.com/LoadingSystems/Solutions/TopsidesPackages/ChicksanMarineLoadingArms.aspx, Dec. 13, 2006, pp. 1-2.

* cited by examiner

*Primary Examiner*—Gregory L Huson
*Assistant Examiner*—Jason K Niesz
(74) *Attorney, Agent, or Firm*—A. Stephen Zavell

(57) ABSTRACT

A method for loading LNG on a floating vessel through a conduit having the inlet, an outlet and an intermediate port located between the inlet and the outlet. The method includes the step of pumping a reduced flow of LNG into the inlet and the step of pumping a reduced flow of LNG into the intermediate port so that different sections of the conduit can be cooled simultaneously. When the conduit has cooled to a temperature suitable for transferring LNG, the method further includes pumping an increased flow of the LNG into the inlet of the conduit. The LNG can then be directed from the outlet to a storage tank onboard a floating vessel.

16 Claims, 3 Drawing Sheets

METHOD FOR LOADING LNG ON A FLOATING VESSEL

FIELD OF THE INVENTION

The present invention relates to the transfer of cryogenic fluids, such as a liquefied natural gas, to a floating vessel for transport to a remote location. More specifically, the invention relates to loading arms and transfer flow lines that are used to transfer cryogenic fluids to/from a floating vessel and the chilling or pre-cooling of such loading arms and lines to suitably low temperatures in preparation for such transfers.

BACKGROUND OF THE INVENTION

Natural gas is often discovered and produced in locations that are remote from where the gas can be marketed and distributed to end users. When suitable pipelines are available, the natural gas can be transported to market in either a gaseous or liquid form, however, there are many instances in which such pipelines are not available or practical for connecting a particular natural gas supply with consumers. When natural gas supplies are located overseas or a substantial distance from a suitable distribution system, it may be necessary to transport the gas by vessel. Such vessels typically include specially designed carriers that transport natural gas as a liquid housed in large insulated containers or tanks.

When transported at or near atmospheric pressure liquefied natural gas (LNG) is held at temperatures slightly below about −160° C. This temperature represents the boiling-point temperature for methane at atmospheric pressure. However, since the composition of natural gas will typically contain variable amounts of heavier and higher boiling hydrocarbons such as ethane, propane, butane and the like, the liquefied gas will be characterized by a somewhat higher boiling temperature, usually ranging from about −151° C. to about −164° C. depending upon composition. At or near a destination, the LNG must be regasified and warmed before it can be introduced into a distribution pipeline. In addition, depending on the requirements of the pipeline and local natural gas specifications, the LNG may be pressurized, depressurized, blended, odorized or subjected to other processing before it can be introduced into a pipeline or similar distribution system.

In both the loading an off-loading of LNG from a vessel, loading arm(s) and flow line(s) are used to transfer the LNG. Due to the relatively low temperature of the LNG, the loading arms and flow lines must be pre-cooled or chilled to cryogenic temperatures before transfer operations can begin. Conventional cool-down procedures can require two to five hours depending on the materials and features of the arm and flow lines, the port requirements, and the recommendations of the loading arm/flow line manufacturer. Modifications that would enable such cool-down procedures to be completed more quickly while complying with port requirements and manufacturer recommendations would be advantageous and would enable additional vessels to be loaded and unloaded at a given terminal each year.

SUMMARY OF THE INVENTION

The present invention provides a method for loading LNG on a floating vessel. The method includes the step of pumping a reduced flow of LNG into an inlet of a conduit, the conduit having the inlet, an outlet and an intermediate port located between the inlet and the outlet. In one embodiment, the LNG is pumped into the conduit at a temperature less than about −160° C. In another embodiment, the LNG is derived from a liquefaction unit on shore and/or a storage container on shore. In still another embodiment, the reduced flow of LNG pumped into the inlet of the conduit is pumped up through a vertical portion of the conduit. Optionally, the method can include purging the conduit with nitrogen before pumping a reduced flow of the LNG into the conduit.

The method further includes the step of pumping a reduced flow of LNG into the intermediate port of the conduit. In one embodiment, the reduced flow of LNG pumped into the intermediate port flows down through a portion of the conduit. In yet another embodiment, the reduced flow of LNG is pumped into the intermediate port located at an apex between the inlet and the outlet. Optionally, the method can include interrupting the reduced flow of LNG to the intermediate port when the conduit has cooled to a temperature suitable for transferring the LNG. When a portion of the reduced flow of LNG pumped into the conduit forms a boil off gas in the conduit, the method can further include the step of removing the boil off gas from the conduit.

When the conduit has cooled to a temperature suitable for transferring LNG, an increased flow of LNG id pumped into the inlet of the conduit. LNG can be directed from the outlet to a storage tank onboard a floating vessel.

BRIEF DESCRIPTION OF THE DRAWINGS

The invention may be understood by reference to the following description taken in conjunction with the accompanying drawings.

Figure 1:
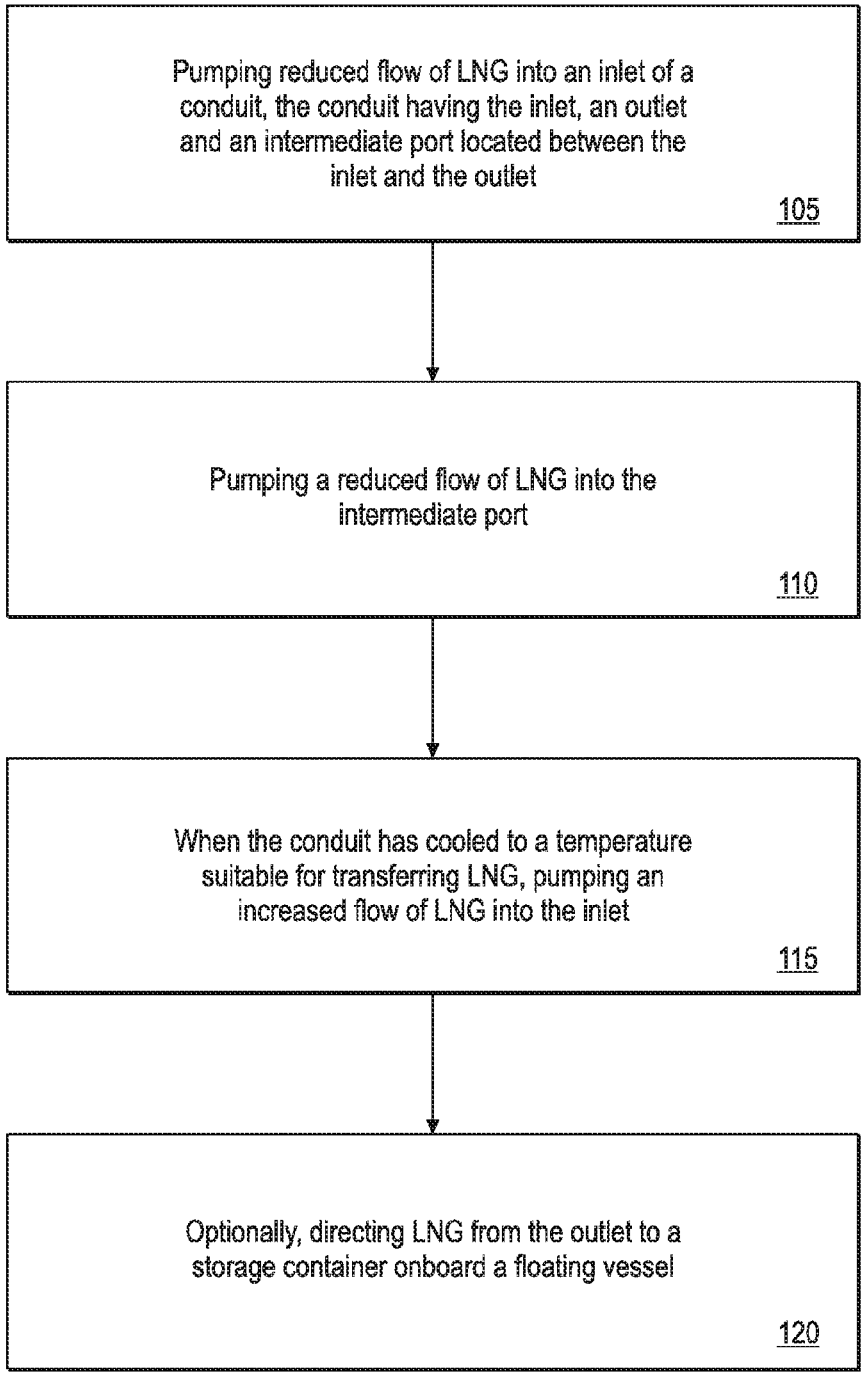
FIG. 1 is a representation of a method of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Illustrative embodiments of the invention are described below. In the interest of clarity, not all features of an actual embodiment are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover it will be appreciated that such a development effort might be complex and time-consuming, but would nevertheless be a routine undertaking for those of ordinary skill in the art having the benefit of this disclosure.

Natural gas can be cooled with or without compression to form liquefied natural gas. The LNG is liquefied in a plant that is typically located on-shore near the site where the natural gas is produced, but may also be located in another location or off-shore depending on the location of the producing gas field. When the LNG is at ambient or near ambient pressures, it must be maintained at a temperature below about −160° in order to maintain it in a condensed or liquid phase.

LNG is frequently held in cryogenic storage to await loading onto a vessel for transport to a remote market. The cryogenic storage is typically adjacent or near the liquefaction plant so as to reduce the amount of boil off gas that might otherwise develop as the LNG is transported from the liquefaction plant to storage. Similarly, it is desirable to locate the cryogenic storage adjacent or near a terminal for loading vessels so as to reduce the amount of boil off gas that might otherwise develop as the LNG is transported from storage to the vessel. As such, LNG storage may be provided adjacent a waterway to enable direct access by floating vessels. In some cases flow lines may be provided to connect on-shore LNG storage with either a near shore or off-shore loading terminal. Jetties are commonly used for near-shore terminals where shore-side berthing at the storage site is unavailable.

Regardless of the precise location of the LNG storage relative to the liquefaction plant and terminal, loading arms and flow lines will be required for loading the LNG on the floating vessel. Loading arms typically include a pedestal that is fixed to a jetty, dock, or vessel deck, a system of articulating conduit sections that are joined together at knuckles or joints, and a counterbalance supporting structure. The pedestal is typically manufactured from carbon steel and provides structural support to the conduit sections and the counterbalance structure. The conduit sections are typically manufactured of high grade stainless steel. The size of these conduits can vary depending on the needs of the terminal, its location and the capacity of the vessels to be loaded. Standard conduit diameters range from 4 inches through 24 inches with more typical sizes ranging between 16 inches and 20 inches. The knuckles or joints between sections of conduit are typically swivel joints that allow the conduit sections to articulate about the joint. The joints are required to carry heavy loads and have seals to prevent product leakage. Conventional LNG loading arms are commercially available from such companies as FMC Technologies, SVT Schwelm GmbH, Niigata Marine Loading Arms, Aker Kvaener Lading Arm Technologies and EMCO WHEATON GmbH.

Depending on the location and the configuration of the terminal, additional conduits or flow lines may be used to transfer LNG to the loading arm or directly to the vessel. Such conduits can also be made of high grade stainless steel, composites such as Invar that experience limited expansion and contraction in response to changes in temperature, as well as other specially designed tubing or hoses. Specially designed hoses and tubing, and systems utilizing such conduits for transferring LNG are described in greater detail in U.S. Pat. No. 4,315,408, issued Feb. 16, 408 to Karl, U.S. Pat. No. 4,445,543 issued May 1, 1984 to Mead, U.S. Pat. No. 6,012,292 issued Jan. 11, 2000 to Gulati, et al., and U.S. Pat. No. 6,244,053 issued Jun. 12, 2001 to Gulati, et al.

The low temperatures of LNG require that these loading arms and flow lines be pre-cooled to cryogenic or near-cryogenic temperatures prior to transfer operations. Failure to pre-cool these conduits will produce thermal stress on the conduit and joints that can result in failure or shortened life. Moreover, a significant amount of LNG will vaporize and form boil off gas as the LNG takes up heat from the relatively warmer conduit. Pre-cooling of the conduit prior to each transfer operation can require several hours depending on the length and configuration of the conduit sections, the local port requirements and recommendations of the manufacturer. The present invention is directed at reducing the time required to pre-cool a transfer or flow line to a cryogenic temperature or other temperature suitable for transferring LNG.

More specifically, the present invention provides a method for loading LNG on a floating vessel. The method includes the steps of pumping a reduced flow of LNG into an inlet of a conduit, the conduit having the inlet, an outlet and an intermediate port located between the inlet and the outlet; pumping a reduced flow of the LNG into the intermediate port; when the conduit has cooled to a temperature suitable for transferring LNG, pumping an increased flow of the LNG into the inlet; and directing the LNG from the outlet to a storage tank onboard a floating vessel. By pumping a reduced flow of LNG into the conduit at both an inlet and an intermediate port, multiple sections of the conduit can be cooled simultaneously.

In operation, a floating vessel having LNG storage tanks, sometimes described herein as an LNG carrier or ship, is first moored at an LNG terminal. There are generally two or more and typically four loading arms at a terminal that are dedicated for transferring LNG to or from the vessel. One of these loading arms will typically be a vapor return arm that is used to direct boil off gas from the vessel's LNG storage tanks to a shore-side facility. Custody Transfer level readings are taken and the valve in the vapor return arm is opened to allow boil off gas on board the ship to be led ashore. This vapor return path also allows the operators to control pressure within the shipboard tanks. In an alternative embodiment, the boil off gas might be re-condensed onboard the vessel and directed to the vessel's storage tanks. In other embodiments, the boil off gas might be directed to an on-board power generation unit. In such alternate embodiments, a vapor return arm and conduit to a shore side facility could be eliminated. After the other loading arm conduits are connected with the ship's manifold, operators can begin to prepare the conduits for transferring LNG.

As noted above, "conduit" is intended herein to refer to a flow line or transfer line used to transfer LNG. Such conduits may or may not be associated with a loading arm. A conduit for transferring LNG to a floating vessel will have an inlet, an outlet and an intermediate port located between the inlet and the outlet. After connecting the outlet of the conduit with the ship's manifold and before the operators begin pre-cooling the conduit, they will typically test the conduit for leaks and oxygen levels, and ensure that emergency systems are functioning properly. Depending on the oxygen level detected, the conduit may be purged before pre-cooling is initiated. Prior to LNG transfer, the oxygen content within the conduit should be less than about 1% vol. When purging is desired, an inert gas such as nitrogen, argon, helium or the like, can be flowed through the conduit.

Pre-cooling of the conduit begins by pumping a reduced flow of LNG into the inlet of a conduit, commonly located at or near the bottom of the pedestal of the loading arm. The LNG is pumped into the conduit at a temperature of less than about −160° C. This reduced flow of LNG can be derived from a liquefaction unit on shore and/or a storage container on-shore. As the reduced flow of LNG slowly fills the conduit from the inlet, the section of the conduit in contact with the LNG is cooled to a temperature suitable for transferring LNG. The rate at which this reduced flow of LNG is pumped into the inlet of the conduit will be controlled so as to prevent thermal shock to the conduit and the storage tanks located onboard the vessel. This cooling rate is generally prescribed by the arm and tank manufacturer but will also depend on the initial temperature and pressure conditions in the tanks onboard the vessel. An acceptable chill rate for typical conduit and tank materials is less than 9° C. per hour.

The time required to adequately chill the conduit before the flow rate of the LNG can be increased will depend on the starting temperature of the conduit, its length and configuration of its sections among other factors. By way of example, the conduit may have a vertical section or riser such that the reduced flow of LNG pumped into the inlet must first fill and rise up through the vertical section before it can reach downstream sections of the conduit. Where the conduit includes articulating sections that are joined by a swivel joint or knuckle, an apex may be formed between the sections depending on the angle between the conduit sections. In a conventional pre-cooling process, such a vertical portion must be completely filled with LNG before the LNG can reach spill over and begin to cool the downstream sections of the conduit.

To begin cooling downstream sections of the conduit more quickly, the methods of the present invention include the step of pumping a reduced flow of LNG into an intermediate port located between the inlet and outlet of the conduit. Optionally, there may be two or more intermediate ports located between the inlet and the outlet of the conduit depending on the length of the conduit and the configuration of its sections. In one embodiment, the intermediate port is located at a joint or knuckle where articulating sections of the conduit are joined. In other embodiments, the intermediate port is located adjacent such a joint so that as the reduced flow of LNG enters the conduit, it flows down through a downstream section of the conduit. In still other embodiments, the intermediate port is located at an apex in the conduit. Optionally, the method can include the step of interrupting the reduced flow of LNG to the intermediate port when the conduit has cooled to a temperature suitable for transferring LNG.

A portion of the reduced flow of LNG pumped into the conduit can form boil off gas in the conduit, as well as in the storage tanks onboard the vessel receiving the LNG. In one embodiment, the boil off gas is removed from the conduit and storage tanks through the vapor return arm described above. In another embodiment, the boil off gas is directed to a liquefaction unit onboard the vessel or to other facilities onboard the vessel. Other options for handling boil off gas onboard the vessel are also noted above.

When the conduit has cooled to a temperature suitable for transferring LNG, an increased flow of LNG is pumped into the inlet. The rate of this increased flow of LNG will depend on the capacity and conditions of the vessel's storage tanks, the vessel's LNG manifold and the size of the conduit. An increased flow of LNG through a 16" conduit can be pumped at a rate of 5000 $m^3$/hr, but again the capacity of a given vessel's LNG manifold may further limit this flow rate.

The LNG can then be directed from the outlet of the conduit to a storage tank onboard the floating vessel.

DETAILED DESCRIPTION OF THE FIGURES

FIG. 1 is a flow chart representation of a method 100. As designated at reference number 105, a reduced flow of LNG is pumped into an inlet of a conduit, the conduit having the inlet, an outlet and an intermediate port located between the inlet and the outlet. Step 110 includes pumping a reduced flow of LNG into the intermediate port of the conduit. The pumping of LNG into the intermediate port introduces LNG at a cryogenic temperature into the conduit at a point downstream from the inlet and enables a distant portion or section of the conduit to be pre-cooled with other sections of the conduit. When the conduit has cooled to a temperature suitable for transferring LNG, an increased flow of LNG is pumped into the inlet, as indicated at 115. The LNG then flows through the pre-cooled conduit and is directed form the outlet to a storage tank onboard the floating vessel as indicated at 120.

Figure 2:
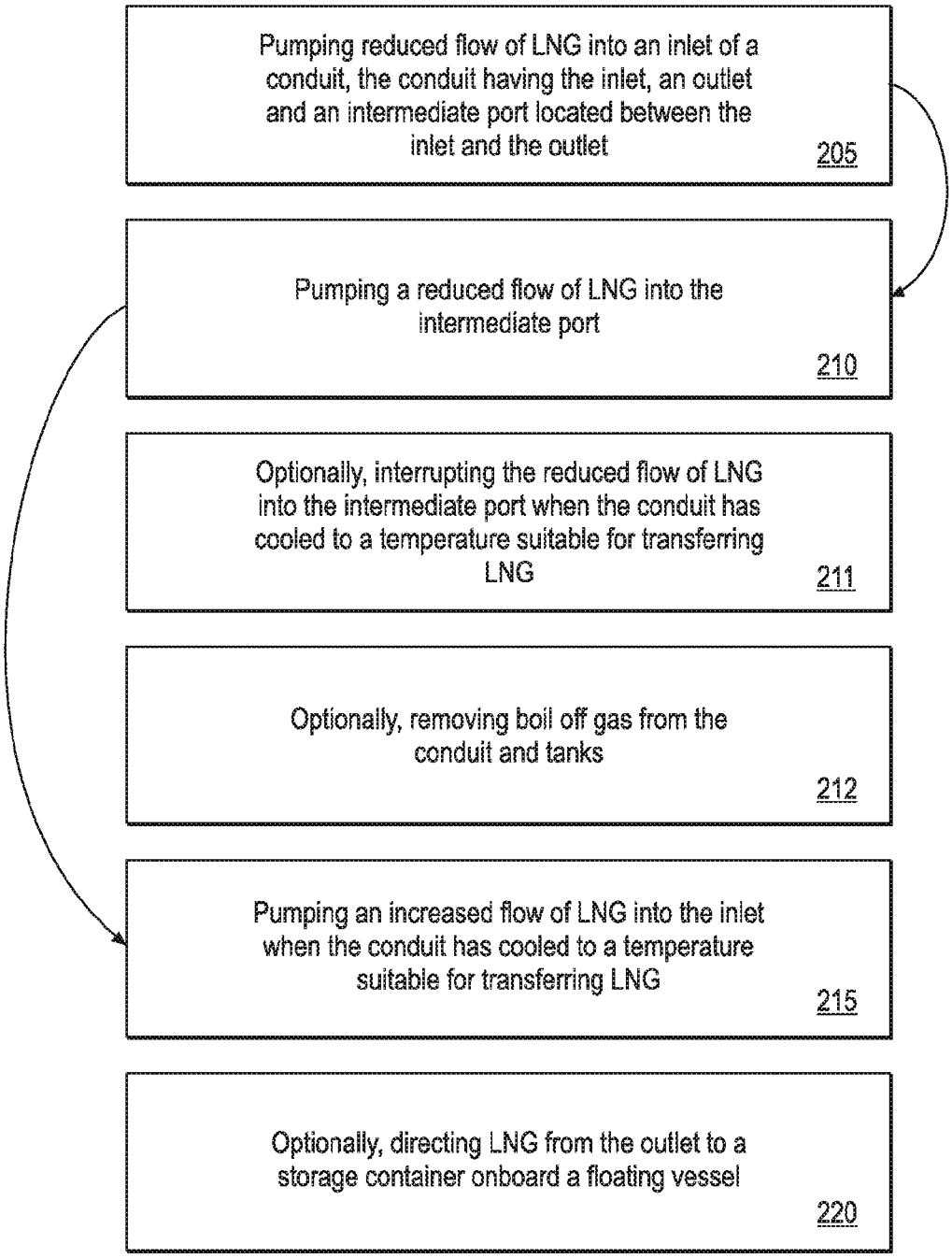
FIG. 2 is a representation of a method of the present invention.

Another method 200 is illustrated in FIG. 2 that includes step 205 wherein a reduced flow of LNG is pumped into an inlet of a conduit, the conduit having the inlet, an outlet and an intermediate port located between the inlet and the outlet. The method includes the step 210 of pumping a reduced flow of LNG into the intermediate port. Optionally the method can include the steps of interrupting the reduced flow of LNG into the intermediate port when the conduit has cooled to a temperature suitable for transferring LNG, 211, and the step 212 of removing boil off gas from the conduit and tanks that may form during the pre-cooling of the flow line. The method further includes step 215, wherein an increased flow of LNG is pumped into the inlet when the conduit had cooled to a temperature suitable for transferring LNG. The LNG then flows through the pre-cooled conduit and is directed from the outlet to a storage tank onboard the floating vessel, as indicated at 220.

Figure 3:
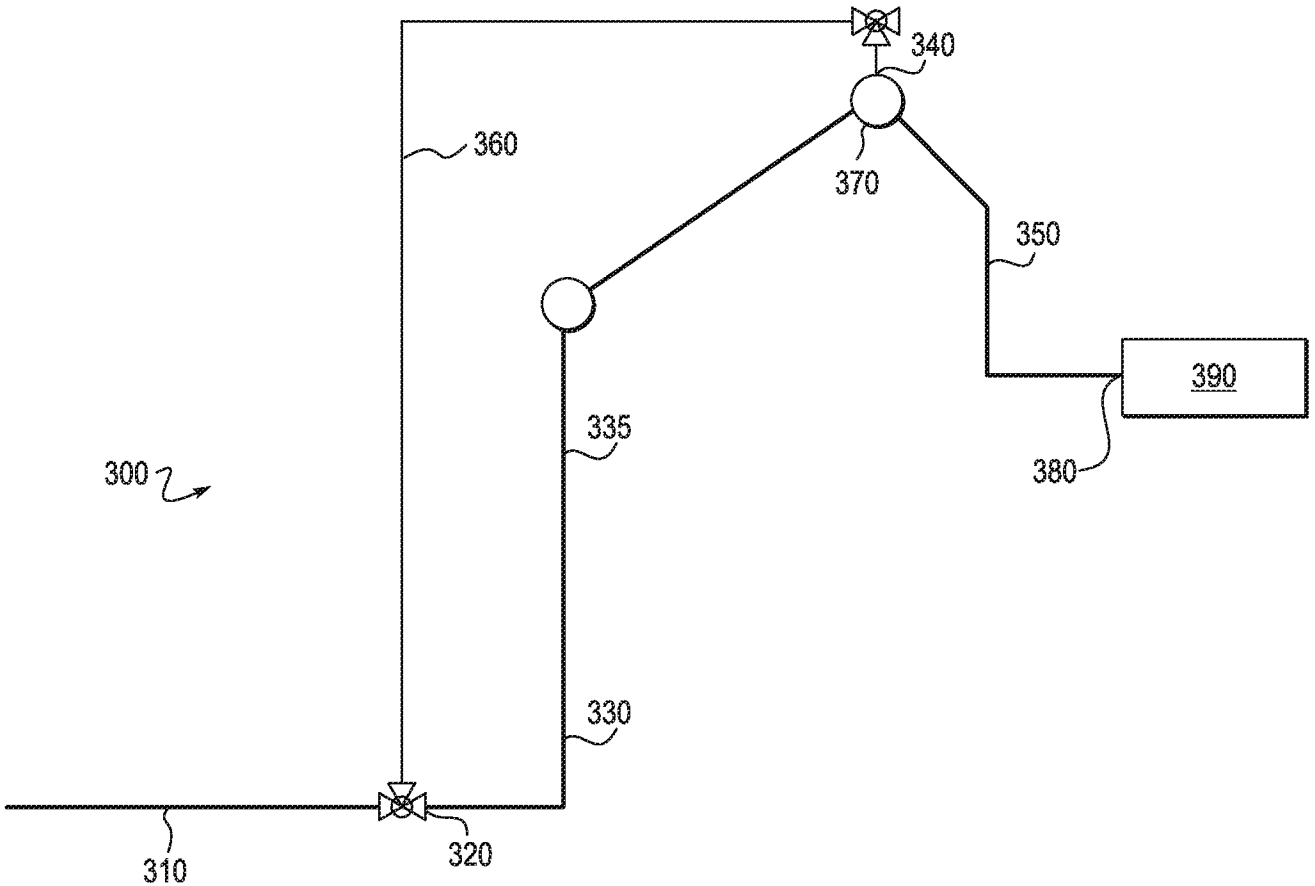
FIG. 3 is a schematic representation of an apparatus for use in a method of the present invention.

FIG. 3 illustrates an apparatus 300 for use in a method of the present invention. The apparatus includes flow line 310 for delivering LNG to the loading arm. The LNG is derived from an onshore storage tank system (not shown). Conduit 330 has inlet 320, outlet 380 and intermediate port 340, which is located at swivel joint 370. A cool down line 360 provides a path for a reduced flow of LNG to be pumped into the conduit at intermediate port 340. Manifold 320 controls the reduced flow of LNG to intermediate port 340. By introducing LNG into intermediate port 340, LNG flows down through conduit section 350 and cools that section at the same time that a reduce flow of LNG is cooling conduit section 335.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method for loading LNG on a floating vessel through a loading arm comprising a conduit, the method comprising the steps of:

pumping a reduced flow of LNG into an inlet of the conduit, the conduit having the inlet, an outlet and an intermediate port located at an apex between the inlet and the outlet;

pumping a reduced flow of the LNG into the intermediate port; and when the conduit has cooled to a temperature suitable for transferring LNG, pumping an increased flow of the LNG into the inlet.

2. The method of claim 1, wherein the LNG is pumped into the conduit at a temperature less than about −160° C.

3. The method of claim 1, wherein the LNG is derived from a liquefaction unit on shore.

4. The method of claim 1, wherein the LNG is derived from a storage tank on shore.

5. The method of claim 1, wherein the reduced flow of LNG pumped into the inlet of the conduit is pumped up through a vertical section of the conduit.

6. The method of claim 1, wherein reduced flow of LNG pumped into the intermediate port flows down through a section of the conduit.

7. The method of claim 1, further comprising interrupting the reduced flow of LNG to the intermediate port when the conduit has cooled to a temperature appropriate for transferring the LNG.

8. The method of claim 1, comprising the step of purging the conduit with an inert fluid before pumping a reduced flow of the LNG into the conduit.

9. The method of claim 1, further comprising directing the LNG from the outlet to a storage tank onboard a floating vessel.

10. A method for transferring a cryogenic fluid between a flow line in fluid communication with an onshore facility and a floating vessel through a movable conduit adapted to be releasably placed in fluid communication with the floating vessel, the method comprising the steps of:

connecting a movable conduit in fluid communication with the floating vessel, the movable conduit having an upstream end and a downstream end and at least one port located intermediate the upstream and downstream ends; wherein: the conduit is included as part of a loading arm;

pumping cryogenic fluid into the upstream end of the conduit to cool a portion of the conduit between the upstream end and the port;

concurrently pumping cryogenic fluid into the port to cool a portion of the conduit between the port and the downstream end; and pumping an increased flow of cryogenic fluid into the upstream end when the conduit has cooled to a temperature suitable for transferring the cryogenic fluid at a higher flow rate through the conduit.

11. The method of claim 10 wherein:

the loading arm has articulated sections including an upstream portion in fluid connection with a downstream portion connected there between by a joint.

12. The method of claim 11 wherein:

the joint is a swivel joint.

13. The method of claim 11 wherein:

the joint includes a port.

14. The method of claim 13 wherein:

the joint is proximate the apex of the loading arm during transfer of cryogenic fluid through the conduit.

15. The method of claim 10 wherein:

the port is located near an apex of the conduit; and the cryogenic fluid flows downwardly downstream through the conduit at least partially under the influence of gravity.

16. The method of claim 10 wherein:

the cryogenic fluid is LNG.

* * * * *